US007264489B2

(12) United States Patent
Higham et al.

(10) Patent No.: US 7,264,489 B2
(45) Date of Patent: Sep. 4, 2007

(54) DUAL CONNECTOR ASSEMBLY WITH PIVOTING KEEP-OUT MEMBER

(75) Inventors: Stephen J Higham, Houston, TX (US); Juan M. Perez, Tomball, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/976,036

(22) Filed: Oct. 27, 2004

(65) Prior Publication Data

US 2006/0089028 A1 Apr. 27, 2006

(51) Int. Cl.
*H01R 13/44* (2006.01)

(52) U.S. Cl. ..... 439/137; 439/139; 361/609

(58) Field of Classification Search ..... 439/137, 439/139; 361/609
See application file for complete search history.

(56) References Cited

U.S. PATENT DOCUMENTS 4,408,813 A * 10/1983 Koehler ..... 439/148
6,038,125 A * 3/2000 Anzai ..... 361/609

* cited by examiner

*Primary Examiner*—Truc Nguyen
(74) *Attorney, Agent, or Firm*—Kevin M. Hart

(57) ABSTRACT

A connector assembly for an electronic device saves space and cost. It includes first and second sockets defining first and second insertion paths for receiving mating plugs. A pivoting keep-out member has first and second blocking surfaces and can be pivoted between first and second positions. In the first position, the first blocking member blocks at least a portion of the first insertion path, but the second blocking member clears the second insertion path. In the second position, the second blocking member blocks at least a portion of the second insertion path, but the first blocking member clears the first insertion path. Thus the connector assembly may receive a plug in either the first or the second socket, but not in both simultaneously.

10 Claims, 2 Drawing Sheets

DUAL CONNECTOR ASSEMBLY WITH PIVOTING KEEP-OUT MEMBER

FIELD OF THE INVENTION

This invention relates generally to electronic hardware. More specifically, the invention relates to connector assemblies.

BACKGROUND

Many electronic devices must be equipped with numerous ports for connecting with a variety of external and internal devices. For example, present-day computers must be equipped with numerous USB ports. Some of the ports must be accessible from outside the computer's enclosure for connection with external USB devices, while others must be accessible from inside the computer's enclosure for connection with internal USB devices. This requirement for plural ports, and for internally and externally accessible ports, increases the cost of electronic devices and consumes space inside the enclosure of the host device.

SUMMARY OF THE INVENTION

In one aspect, the invention includes a space-saving and cost-saving connector assembly. The connector assembly includes first and second sockets or plugs oriented at substantially 180 degrees from one another. The first and second sockets or plugs define first and second insertion paths, respectively, for receiving mating plugs or sockets. The connector assembly also includes a pivoting keep-out member having first and second blocking surfaces. The keep-out member can be pivoted between first and second positions. In the first position, the first blocking member blocks at least a portion of the first insertion path, but the second blocking member clears the second insertion path. In the second position, the second blocking member blocks at least a portion of the second insertion path, but the first blocking member clears the first insertion path. Thus the connector assembly may receive a plug or socket in either the first or the second sockets or plugs, but not in both simultaneously.

In another aspect, the connector assembly may be mounted in an electronic device having an enclosure such that the first socket or plug is accessible from outside the enclosure and the second socket or plug is accessible from inside the enclosure.

DETAILED DESCRIPTION OF THE PREFERRED EMBODIMENTS

The drawings depict a universal serial bus ("USB") connector assembly in a computer according to a preferred embodiment of the invention. The USB connector assembly and its context are shown by way of illustration and example only. Persons having ordinary skill in the art and having reference to this description and the drawings will readily appreciate that equivalent embodiments on the invention may be constructed for connectors other than USB connectors, and for electronic devices other than computers.

Figure 1:
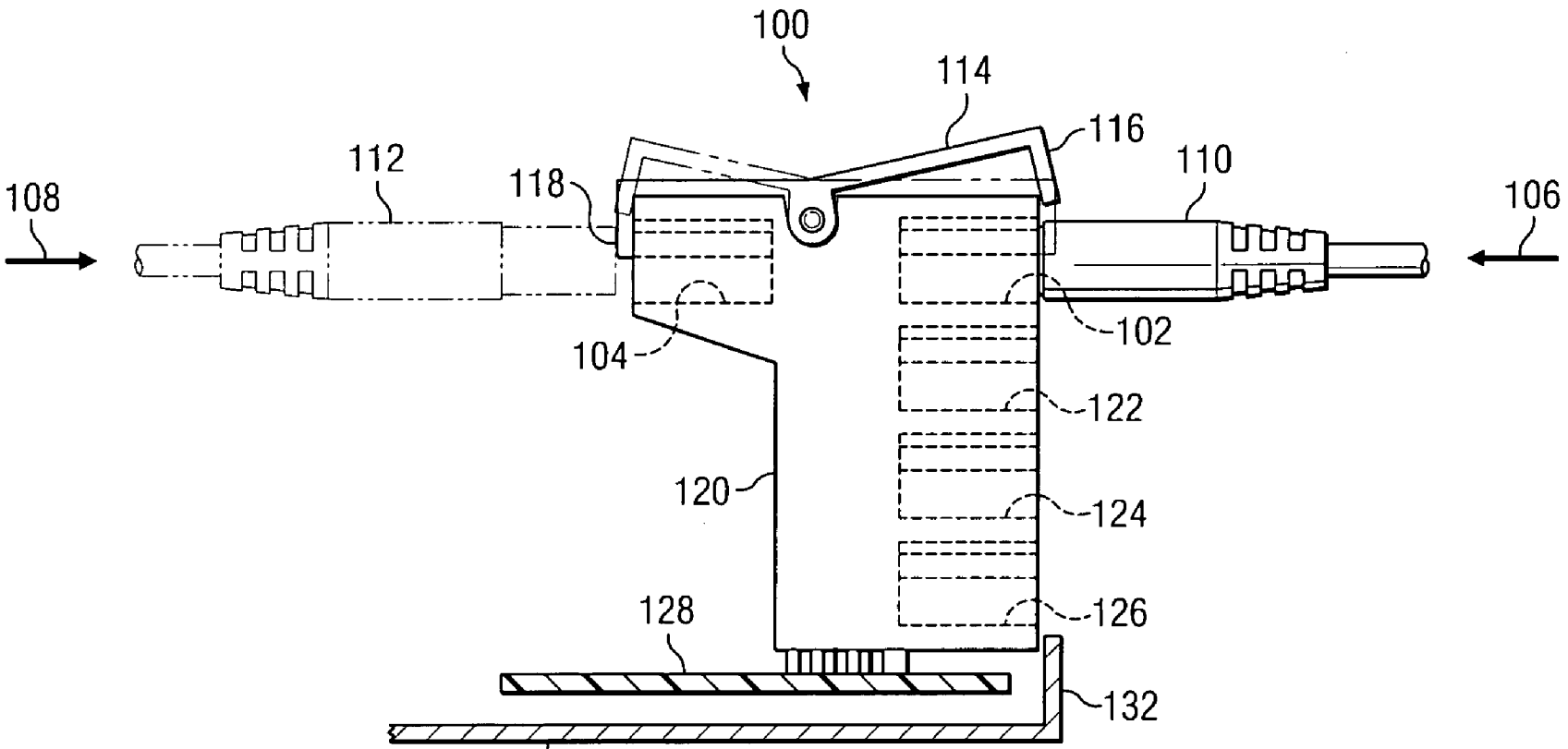
FIG. 1 is a side view of a connector assembly according to a preferred embodiment of the invention.
Figure 2:
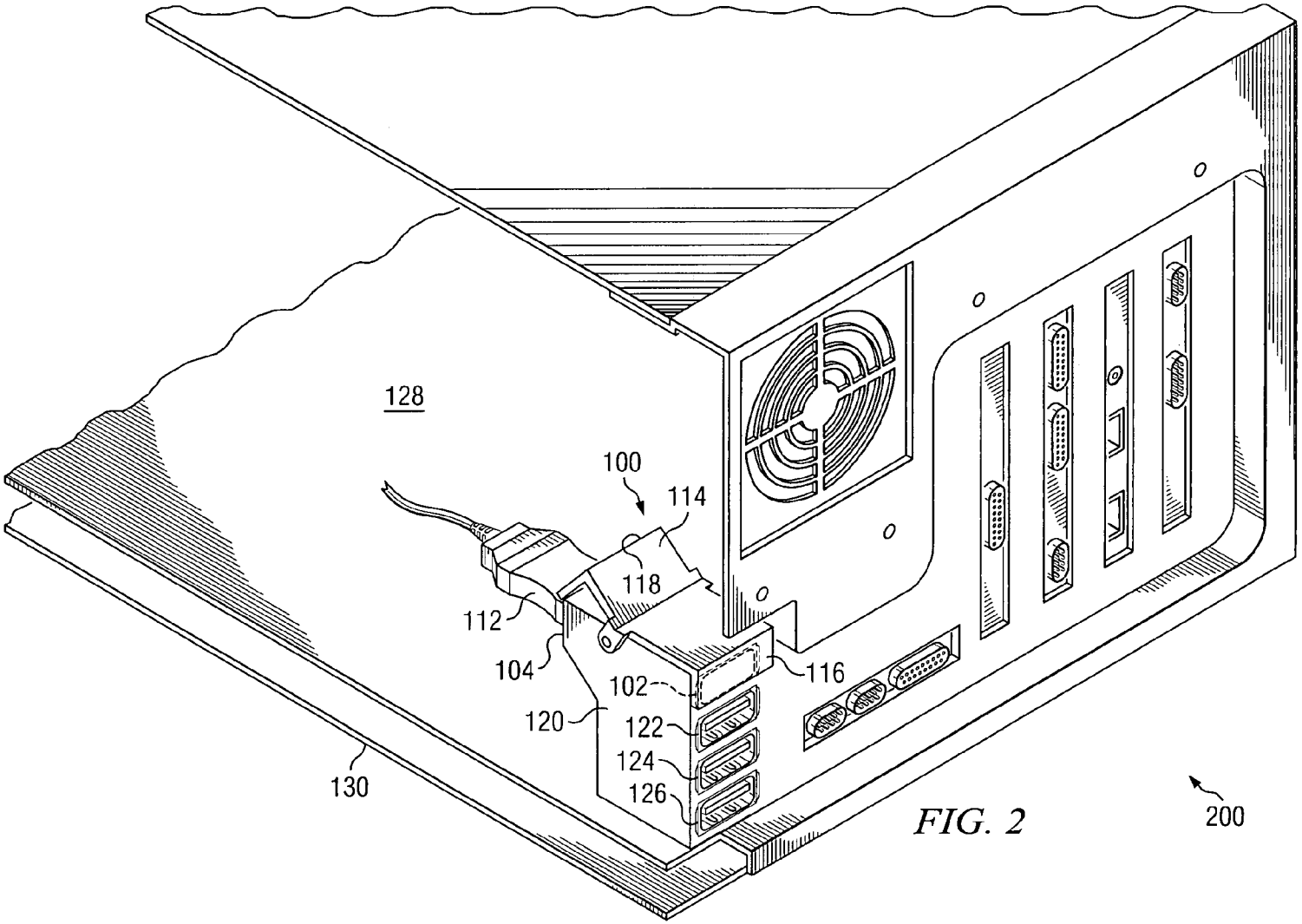
FIG. 2 is a cutaway view of an electronic device that includes a connector assembly according to a preferred embodiment of the invention.

Connector assembly 100 includes USB sockets 102, 104 oriented at substantially 180 degrees from one another. Sockets 102, 104 define insertion paths 106, 108, respectively, for receiving mating plugs 110, 112. In alternative embodiments, the roles of the sockets and plugs may be reversed with similar effect. Connector assembly 100 also includes a pivoting keep-out member 114 having blocking members 116, 118. Keep-out member 116 is capable of pivoting between the first position illustrated in FIG. 1 with solid lines and a second position illustrated in FIG. 1 with broken lines. In the first position, blocking member 118 blocks at least a portion of insertion path 108 but blocking member 116 clears insertion path 106. In the second position, blocking member 116 blocks at least a portion of insertion path 106 but blocking member 118 clears insertion path 108. Consequently, only one of plugs 110, 112 may be mated with sockets 102, 104 at any given time.

For ease of manufacture and assembly, sockets 102, 104 may be contained in a housing 120, and keep-out member 114 may be mounted to housing 120 substantially as shown. Housing 120 and keep-out member 114 may be constructed using any suitable material, such as molded plastic. Housing 120 may also contain other sockets or plugs such as sockets 122, 124, 126 disposed in a stacked relationship with either of sockets or plugs 102, 104.

The assembly may be mounted and electrically connected to a printed circuit board 128 contained inside the enclosure 130 of an electronic device such as a computer 200. Preferably, assembly 100 should be oriented such that socket 102 is accessible from outside enclosure 130, while socket 104 is accessible from inside enclosure 130, as shown.

What is claimed is:

1. A connector assembly, comprising:

first and second USB sockets or plugs whose mating ports face away from each other in substantially opposite directions and define first and second insertion paths, respectively, for receiving mating plugs or sockets; and a pivoting keep-out member having first and second blocking members and capable of movement between first and second positions such that, in the first position, the first blocking member blocks at least a portion of the first insertion path but the second blocking member clears the second insertion path and, in the second position, the second blocking member blocks at least a portion of the second insertion path but the first blocking member clears the first insertion path.

2. A connector assembly, comprising:

first and second sockets or plues whose matina ports face away from each other in substantially opposite directions and define first and second insertion paths, respectively, for receiving mating plugs or sockets; and a pivoting keep-out member having first and second blocking members and capable of movement between first and second positions such that, in the first position, the first blocking member blocks at least a portion of the first insertion path but the second blocking member clears the second insertion path and, in the second position, the second blocking member blocks at least a portion of the second insertion path but the first blocking member clears the first insertion path;

wherein the first and second sockets or plugs are contained in a housing, and the keep-out member is mounted to the housing.

3. The connector assembly of claim 2, wherein:

the housing also contains at least a third socket or plug disposed in a stacked relationship with either the first or the second socket or plug.

4. A connector assembly, comprising:

first and second sockets or plugs whose mating ports face away from each other in substantially opposite directions and define first and second insertion paths, respectively, for receiving mating plugs or sockets; and a pivoting keep-out member having first and second blocking members and capable of movement between first and second positions such that in the first position, the first blocking member blocks at least a portion of the first insertion path but the second blocking member clears the second insertion path and in the second position the second blocking member blocks at least a portion of the second insertion path but the first blocking member clears the first insertion path;

wherein the assembly is mounted in an electronic device having an enclosure such that the first socket or plug is accessible from outside the enclosure and the second socket or plug is accessible from inside the enclosure.

5. The connector assembly of claim 4, wherein:

the electronic device is a computer.

6. An electronic device, comprising:

an enclosure; and a connector assembly, the connector assembly comprising:

first and second sockets or plugs defining first and second insertion paths, respectively, for receiving mating plugs or sockets;

wherein the first and second insertion paths are oriented at substantially 180 degrees from one another; and a pivoting keep-out member having first and second blocking members and capable of pivoting between first and second positions such that, in the first position, the first blocking member blocks at least a portion of the first insertion path but the second blocking member clears the second insertion path and, in the second position, the second blocking member blocks at least a portion of the second insertion path but the first blocking member clears the first insertion path;

wherein the connector assembly is disposed within the electronic device such that the first socket or plug is accessible from outside the enclosure and the second socket or plug is accessible from inside the enclosure.

7. The electronic device of claim 6, wherein:

the electronic device is a computer.

8. The electronic device of claim 6, wherein:

the first and second sockets or plugs are USB sockets or plugs.

9. The electronic device of claim 6, wherein:

the first and second sockets or plugs are contained in a housing, and the keep-out member is mounted to the housing.

10. The electronic device of claim 9, wherein:

the housing also contains at least a third socket or plug disposed in a stacked relationship with either the first or the second socket or plug.

* * * * *

UNITED STATES PATENT AND TRADEMARK OFFICE

CERTIFICATE OF CORRECTION

PATENT NO. : 7,264,489 B2
APPLICATION NO. : 10/976036
DATED : September 4, 2007
INVENTOR(S) : Stephen J. Higham et al.

It is certified that error appears in the above-identified patent and that said Letters Patent is hereby corrected as shown below:

In column 2, line 51, in Claim 2, delete “plues” and insert -- plugs --, therefor.

In column 2, line 51, in Claim 2, delete “matina” and insert -- mating --, therefor.

In column 3, line 11, in Claim 4, after “such that” insert -- , --.

In column 3, line 14, in Claim 4, after “path and” insert -- , --.

In column 3, line 15, in Claim 4, after “position” insert -- , --.

Signed and Sealed this

First Day of July, 2008

JON W. DUDAS
*Director of the United States Patent and Trademark Office*